US008095062B2

(12) United States Patent
Maddux et al.

(10) Patent No.: US 8,095,062 B2
(45) Date of Patent: Jan. 10, 2012

(54) MEDIA WIDTH SENSORS CONTAINING AXIALLY SPACED PADDLES AND METHOD OF USING THE MEDIA WIDTH SENSOR

(75) Inventors: Thomas Paul Maddux, Lexington, KY (US); Clark Edwin Jarnagin, Lexington, KY (US); Daniel P. Cahill, Verona, KY (US)

(73) Assignee: Lexmark International, Inc., Lexington, KY (US)

( * ) Notice: Subject to any disclaimer, the term of this patent is extended or adjusted under 35 U.S.C. 154(b) by 777 days.

(21) Appl. No.: 11/851,740

(22) Filed: Sep. 7, 2007

(65) Prior Publication Data

US 2009/0067907 A1 Mar. 12, 2009

(51) Int. Cl.
*G03G 15/00* (2006.01)

(52) U.S. Cl. ..... 399/389; 399/370; 399/376; 271/259; 271/261; 271/270

(58) Field of Classification Search ..... 399/389, 399/370, 376; 271/270, 259, 261
See application file for complete search history.

(56) References Cited

U.S. PATENT DOCUMENTS 7,742,736 B2 * 6/2010 Kobayashi et al. ..... 399/389
2007/0030329 A1 * 2/2007 Wiens ..... 347/171

FOREIGN PATENT DOCUMENTS

JP 08119534 A * 5/1996

* cited by examiner

*Primary Examiner* — Matthew G Marini
(74) *Attorney, Agent, or Firm* — Justin M. Tromp; John Victor Pezdek

(57) ABSTRACT

The present application is directed to sensors and methods of use to determine a width of a media sheet moving along a media path. In one embodiment, the sensor includes a shaft that extends at least partially across the media path. First and second paddles may extend outward from the shaft and into the media path. The paddles may be axially spaced apart along a length of the shaft, and the first paddle may be positioned upstream along the media path from the second paddle. A flag may extend outward from the shaft. A detector may be positioned in proximity to the shaft. In use, the shaft may rotate during contact between the media sheets and the paddles to move the flag. The detector may be able to differentiate between a first amount of rotation due to contact with a wide media sheet and a second amount of rotation with a narrow media sheet to determine a width of the media sheets.

17 Claims, 5 Drawing Sheets

MEDIA WIDTH SENSORS CONTAINING AXIALLY SPACED PADDLES AND METHOD OF USING THE MEDIA WIDTH SENSOR

BACKGROUND

The present application relates generally to the field of image forming apparatus, and in particular, to sensors to detect the width of a media sheet as it moves along a media path within the image forming apparatus.

Image forming apparatus move a media sheet through an extended media path. The media sheet undergoes numerous image forming operations along the path such as initial input into the media path from an input tray or exterior input, image transfer area, and adhering the image to the media sheet. Problems can occur during these operations, especially if the device cannot anticipate and make adjustments to accommodate for different widths of media sheets.

In image forming apparatus with a fusing area, narrow media sheets moving through the fusing area may cause uneven heating of the fusing members. The uneven heating occurs between a first section of the fusing members that are contacted by the media sheets, and a second section that is not contacted by the media sheets. The first section maintains a first temperature range, while the second section maintains a second, higher temperature range. This uneven heating of the fusing members may result in inadequate fusing of the toner to the media sheets. The unequal heating may also decrease the life and reliability of the fusing members.

Another area affected by the width of the media sheets is the image transfer area. This area should be configured to prevent transfer of the image at a point off of the media sheet. Further, media sheets of differing widths may be moved along the media path in a different manner. This is especially evident when the media sheets are aligned to a particular reference location along the media path. Mishandling of the media sheets may result in media jams that can cause frustration, time, and money. Thus, there is a need for an effective manner to detect the width of a media sheet.

SUMMARY

The present application is directed to sensors and methods of use to determine a width of a media sheet moving along a media path. In one embodiment, the sensor includes a shaft that extends at least partially across the media path. First and second paddles may extend outward from the shaft and into the media path. The paddles may be axially spaced apart along a length of the shaft, and the first paddle may be positioned upstream along the media path from the second paddle. A flag may extend outward from the shaft. A detector may be positioned in proximity to the shaft. In use, the shaft may rotate during contact between the media sheets and the paddles to move the flag. The detector may be able to differentiate between a first amount of rotation due to contact with a wide media sheet and a second amount of rotation with a narrow media sheet to determine a width of the media sheets.

DETAILED DESCRIPTION

Figure 1:
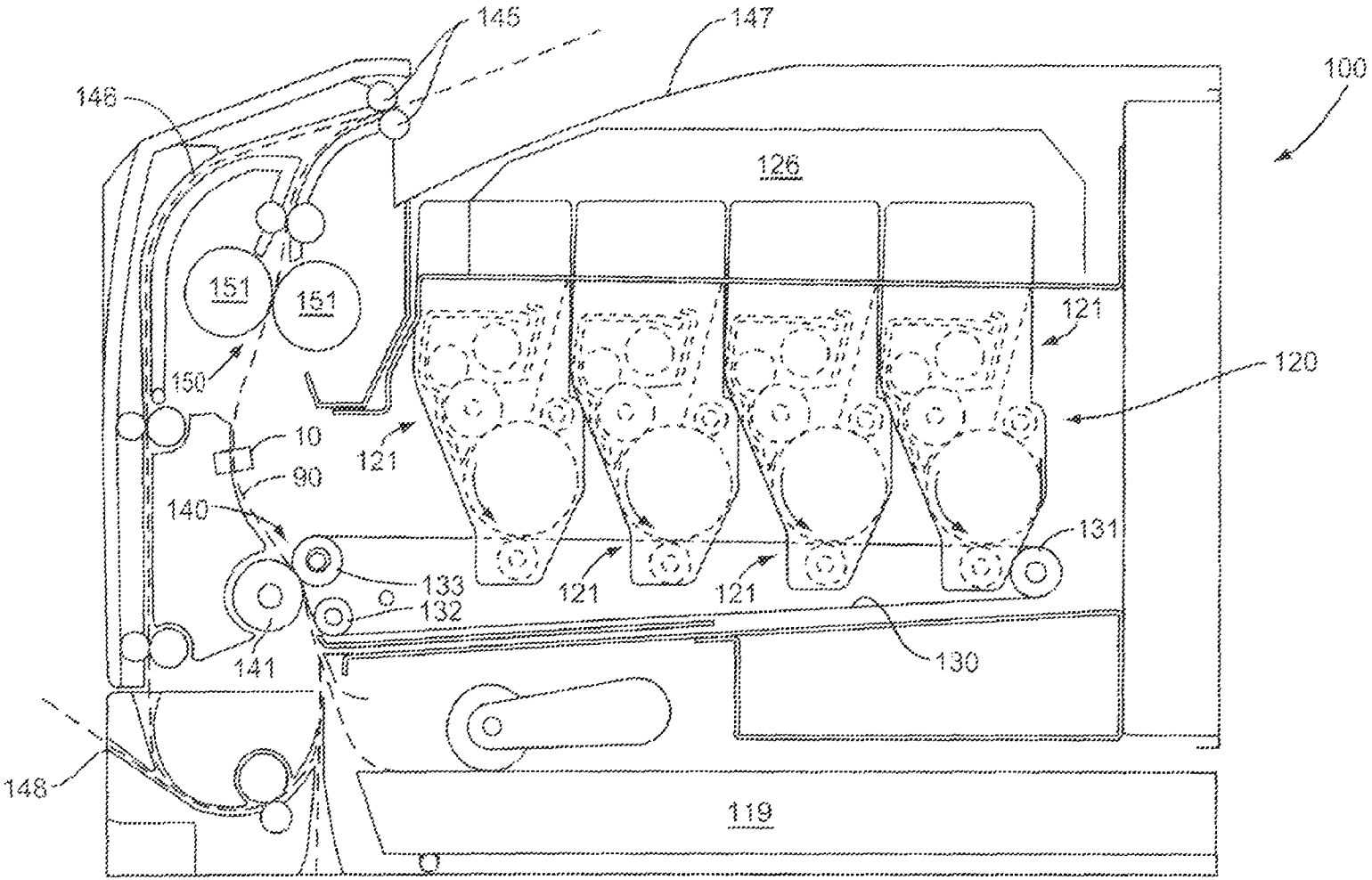
FIG. 1 is a schematic side view of an image forming apparatus according to one embodiment.

The present application is directed to a media width sensor 10 for use in an image forming apparatus 100. FIG. 1 illustrates one embodiment of a sensor 10 positioned within the image forming apparatus 100. The sensor 10 is positioned along a media path 90. The sensor 10 determines a width of the media sheets as they move along the media path 90.

The apparatus 100 of FIG. 1 includes first toner transfer area 120 with one or more imaging units 121. Each imaging unit 121 includes a photoconductive (PC) drum that is charged to a specified voltage such as −1000 volts, for example. A laser beam from a printhead 126 contacts the surface of the PC drum and discharges those areas it contacts to form a latent image. In one embodiment, areas on the PC drum illuminated by the laser beam are discharged to approximately −300 volts. Toner is transferred from a reservoir within the imaging unit to the PC drum to form a toner image. The toner is attracted to the areas of the PC drum surface discharged by the laser beam from the printhead 126.

An intermediate transfer mechanism (ITM) 130 is disposed adjacent to each of the imaging units 121. In this embodiment, the ITM 130 is formed as an endless belt trained about support roller 131, tension roller 132 and back-up roller 133. During image forming operations, the ITM 130 moves past the imaging units 121 in a clockwise direction as viewed in FIG. 1. One or more of the PC drums apply toner images in their respective colors to the ITM 130. In one embodiment, a positive voltage field attracts the toner image from the PC drums to the surface of the moving ITM 130.

The ITM 130 rotates and collects the one or more toner images from the imaging units 121 and then conveys the toner images to a media sheet at a second transfer area. The second transfer area includes a second transfer nip 140 formed between the back-up roller 133 and a second transfer roller 141.

A media path 90 extends through the apparatus 100 for moving the media sheets through the imaging process. The media sheets are initially stored in an input tray 119 or introduced through a manual feed 148. The sheets in the input tray 119 are contacted by a pick mechanism and moved into the media path 90. For sheets entering through the manual feed 148, one or more rollers are positioned to move the sheet into the second transfer nip 140.

The media sheets receive the toner image from the ITM 130 as it moves through the second transfer nip 140. The media sheets with toner images are then moved along the media path 90 and into a fuser area 150. Fuser area 150 includes fusing members 151 such as rollers or belts that form a nip to adhere the toner image to the media sheet. The fused media sheets then pass through exit rollers 145 that are located downstream from the fuser area 150. Exit rollers 145 may be rotated in either forward or reverse directions. In a forward direction, the exit rollers 145 move the media sheet from the media path 90 to an output area 147. In a reverse direction, the exit rollers 145 move the media sheet into a duplex path 146 for image formation on a second side of the media sheet.

The sensor 10 may be positioned at various locations along the media path 90 to detect a width of the media sheets. FIG. 1 illustrates the sensor 10 positioned between the second transfer area 140 and fuser area 150. Sensor 10 may be positioned at various other locations, such as upstream from the second transfer area 140, downstream from the fuser area 150, and within the duplex path 146. In one embodiment, the sensor 10 is positioned upstream of the fuser area 150 to prevent over-heating and damage to the fusing members 151. Multiple sensors 10 may also be positioned along the media path 90.

The terms "upstream" and "downstream" describe the position of elements relative to the direction of media sheet movement along the media path 90. A media sheet moving along the media path 90 will pass an upstream element prior to passing a downstream element. By way of example and using the embodiment of FIG. 1, the second transfer area 140 is upstream from the fuser area 150. The sensor 10 is downstream from second transfer area 140 and the input tray 119.

Figure 2:
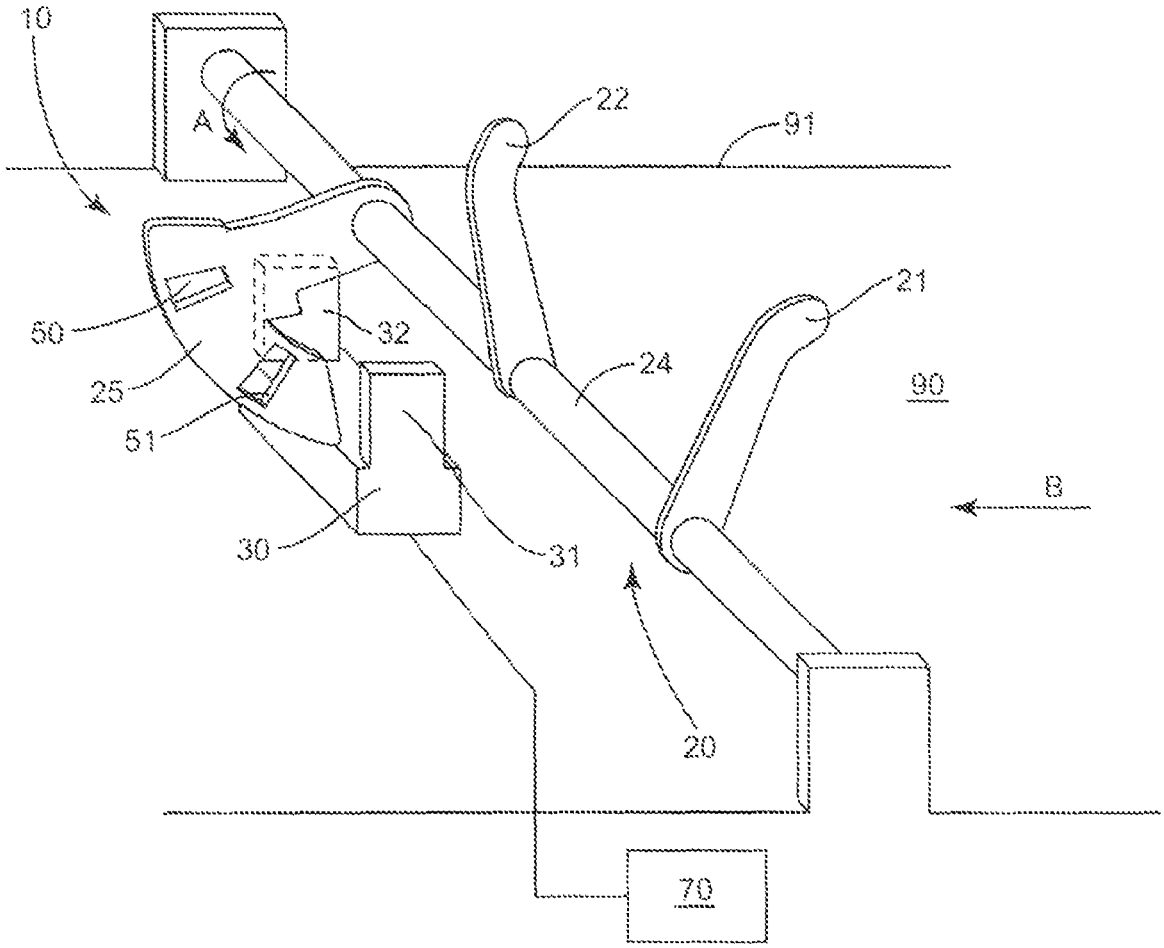
FIG. 2 is a perspective view of a media width sensor according to one embodiment.

FIG. 2 illustrates one embodiment of a sensor 10 positioned along the media path 90. Sensor 10 includes an arm 20 that extends across at least a section of a media path 90. The arm 20 in FIG. 2 extends across the entire width of the media path 90, although other embodiments may include the arm 20 extending across a limited width. Arm 20 includes a shaft 24 with two or more outwardly-extending paddles 21, 22. The paddles 21, 22 are positioned at different locations along the width of the media path 90. Paddles 21, 22 are also positioned with paddle 21 being upstream from paddle 22. A flag 25 with openings 50, 51 extends outward from the shaft 24 and travels through a detector 30 during rotation of the arm 20.

Media sheets are aligned along a reference location 91 as they move along the media path 90 in the direction of arrow B. The media sheet strike one of the paddles 21, 22 depending upon the media sheet width. A wide sheet will contact paddle 21, and a narrow sheet will contact paddle 22. Contact with the media sheet causes the arm 20 to rotate and the flag 50 to move through the detector 30. Contact of the different paddles 21, 22 causes different degrees of rotation of the arm 20 that are differentiated by the detector 30.

The paddles 21, 22 are axially spaced apart along the shaft 24 and positioned across the media path 90. The paddles 21, 22 are positioned a distance away from the reference location 91 that aligns the media sheets while they move along the media path 90. As illustrated in FIG. 2 and the side view of FIG. 3, paddle 21 is located upstream from paddle 22. In this embodiment, each of the paddles 21, 22 includes substantially the same shape. The paddles 21, 22 extend outward at different angular orientations causing paddle 21 to be positioned upstream from paddle 22. Further, the upstream paddle 21 is positioned a greater distance away from the reference location 91 than the downstream paddle 22.

Flag 25 extends outward from the shaft 24 at a different angular position than the paddles 21, 22. Flag 25 is positioned to move through the detector 30 during rotation of the arm 20. A pair of windows 50, 51 extends through the flag 25 and are positioned to move through the detector 30 during rotation of the arm 20. In the embodiment of FIG. 2, the windows 50, 51 are substantially the same shape and size. In another embodiment, windows 50, 51 include different shapes and/or sizes.

Detector 30 includes a transmitter 31 and a receiver 32. The transmitter 31 emits a signal that is detectable by receiver 32. In one embodiment, the signal is electromagnetic energy. In one embodiment, sensor 30 is an optical sensor. Thus, transmitter 31 emits optical energy with a frequency spectrum that is detectable by receiver 32. The transmitter 31 may be embodied as an LED, laser, bulb or other source. Receiver 32 changes operating characteristics based on the presence and quantity of optical energy received. The receiver 32 may be a phototransistor, photodarlington, or other detector. The optical energy may consist of visible light or near-visible energy (e.g., infrared or ultraviolet). Further, flag 25 is positioned within the transmission path between the transmitter 31 and receiver 32. Where an optical sensor 30 is used, the flag 25 is positioned within the optical path between the transmitter 31 and receiver 32 and operates as an interrupter of sorts.

Controller 70 determines the width of the media sheets based on signals received from the detector 30. In one embodiment, controller 70 includes a microcontroller with associated memory. Controller 70 may oversee movement of the media sheet along the entire media path 90, or may just determine the width of the media sheet as it moves through the sensor 10.

Figure 3:
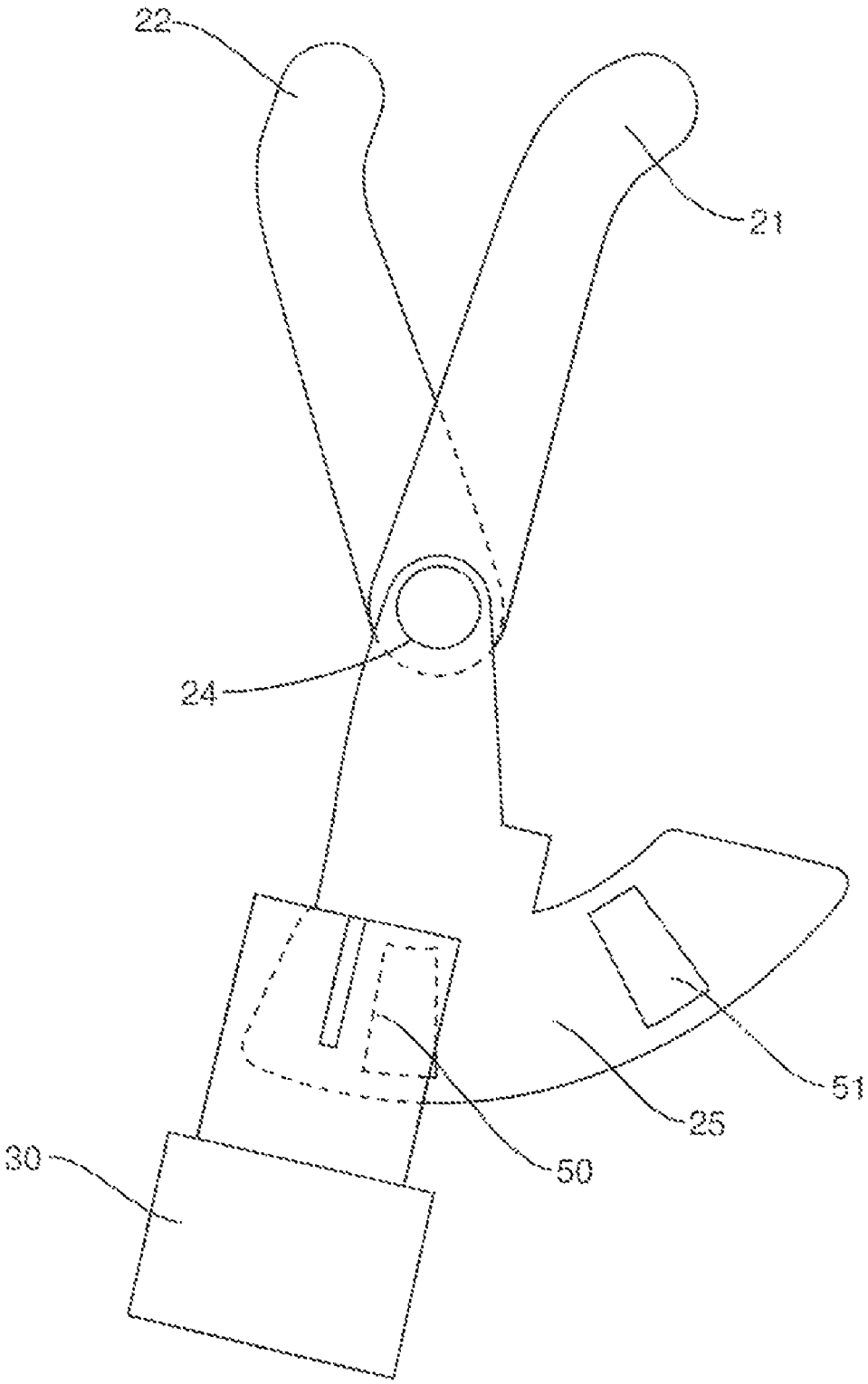
FIG. 3 is a side view of a media width sensor according to one embodiment.

In one method of use with the embodiment illustrated in FIGS. 2 and 3, the media sheet moves along the media path 90 and is aligned along the reference location 91. If the media sheet is relatively wide, it will contact the paddle 21. This contact causes the arm 20 to rotate in a direction of arrow A thus causing the flag 25 to move within the detector 30. The upstream positioning of paddle 21 will cause a first amount of rotation that causes both windows 50, 51 to move within the transmission path between the transmitter 31 and receiver 32. This causes a first disturbance pattern in the energy that is then signaled to the controller 70. Controller 70 is programmed to associate the first disturbance pattern with a media sheet with a first width. The media sheet continues movement along the media path 90 and eventually passes beyond the arm 20. Arm 20 then rebounds to the initial position as illustrated in FIG. 2. In one embodiment, the arm 20 is weighted to return to the initial position. In another embodiment, a biasing member (not illustrated) may return the arm 20 to the initial position.

A second, narrower media sheet moving along the media path 90 contacts paddle 22. Because of the narrow width, the media sheet will not contact paddle 21. Contact with paddle 22 causes the arm 20 to rotate a second amount causing only window 51 to move within the transmission path between the transmitter 31 and receiver 32. Contact with the second paddle 22 causes the arm 20 to rotate a lesser degree because of the downstream position of the paddle 22 along the shaft 20. This movement of the flag 25 within the detector 30 causes a second disturbance pattern that is signaled to the controller 70 which associates the signal with a media sheet of a second, narrower width.

In this embodiment, upstream paddle 21 is positioned a greater distance from the reference location 91 than downstream paddle 22. This ensures each media sheet will only contact a single paddle. A wide media sheet will only contact the upstream paddle 21, and will be spaced away from the downstream paddle 22. Likewise, a narrow media sheet will only contact the downstream paddle 22 and not the upstream paddle 21. In another embodiment, the media sheet contacts each of the paddles 21, 22 with the sheet initially contacting one of the paddles and then subsequently contacting the other paddle as the media sheet moves further along the media path 90.

In the described method, signals are caused by either one or both windows 50, 51 moving through the detector 30. In other embodiments, disturbance patterns may be caused by more than two windows moving within the transmission path. Also, windows 50, 51 may include different shapes and sizes that cause different detectable patterns. In another embodiment, a first width media sheet moves the arm 20 such that no windows pass through the detector 30, while a second width media sheet causes at least one window to move within the detector 30.

Figure 4:
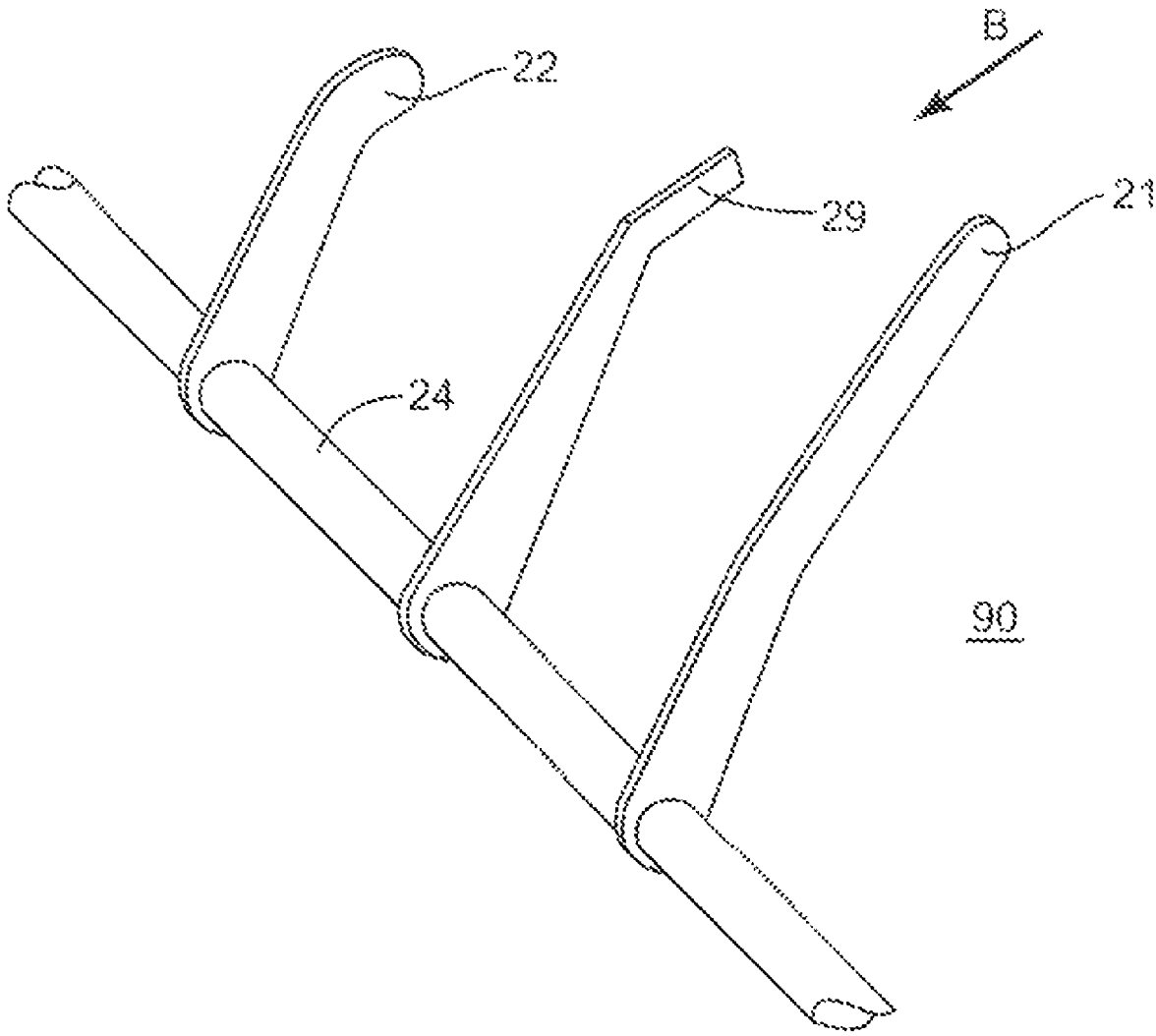
FIG. 4 is a partial perspective view of an arm of a sensor according to one embodiment.

FIG. 2 includes an embodiment with two paddles 21, 22. FIG. 4 illustrates another embodiment with a third paddle 29 extending outward from the shaft 24. Each of the paddles 21, 22, 29 are positioned at a different location along the media path to allow detection of media sheet of three different widths.

FIG. 2 also includes an embodiment with the paddles 21, 22 including substantially the same shape. FIG. 4 is an embodiment with each of the paddles 21, 22, 29 including a different shape. In this embodiment, paddle 21 includes a shape and is sized to be upstream from paddles 22 and 29. Paddle 22 includes a shape and size to be downstream of paddles 21 and 29. Paddle 29 is shaped and sized to be positioned between paddles 21 and 22. Each of the paddles 21, 22, 29 extends from the shaft 24 at substantially the same angular position with the different shapes causing the relative positioning along the media path 90.

Figure 5:
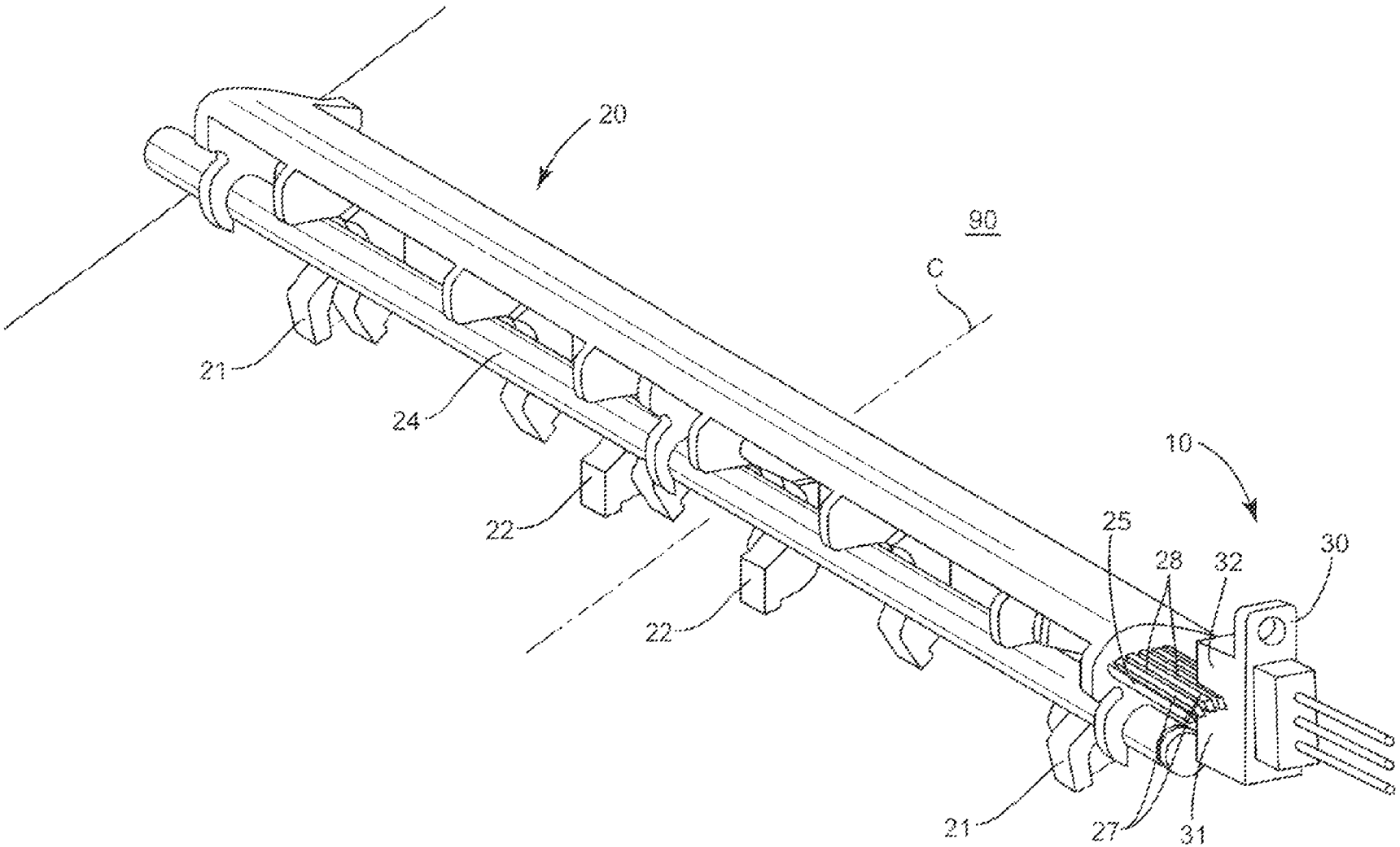
FIG. 5 is a perspective view of a media width sensor according to one embodiment.

In the embodiment of FIG. 5, paddles 21, 22 each include multiple members. A first upstream paddle 21 includes two separate members that are aligned at the same position along the media path 90. A second downstream paddle 22 includes two separate members aligned at the same position. In this embodiment, each of the members of both paddles 21, 22 are symmetrically aligned relative to a center C of the media path 90. In other embodiments, paddles 21, 22 may be asymmetrically positioned along the width of the media path 90.

The embodiment of FIG. 2 illustrates an embodiment with the media sheets being referenced along a reference location 91 on a lateral side of the media path 90. FIG. 5 illustrates another embodiment with the media sheets being aligned along a center C of the media path 90. The first upstream paddle 21 comprising two separate members are positioned upstream of members of paddle 22. Each of the members of paddle 21 are positioned a greater distance from the center C than the members of paddle 22. A first wide media sheet moving along the media path will contact each member of paddle 21 causing the arm 20 to rotate. Likewise, a narrow media sheet will contact each member of paddle 22. The wide media sheet will be spaced away from paddle 22, and the narrow media sheet will be spaced away from paddle 21.

In the embodiment of FIG. 5, flag 25 comprises a number of extensions 27 that extend axially relative to shaft 24 and are spaced apart by gaps 28. The extensions 27 and gaps 28 move through the detector 30 causing a disturbance pattern that is detected by the detector 30 and signaled to controller 70 (not illustrated in FIG. 5). In the example embodiment illustrated in FIG. 5, transmitter 31 is positioned radially inward from flag 25 and receiver 32 is positioned radially outward from flag 25; however, one skilled in the art will appreciate that this configuration may be reversed, as desired, such that receiver 32 is positioned radially inward from flag 25 and transmitter 31 is positioned radially outward from flag 25.

The embodiment illustrated in FIG. 1 includes a color laser printer with a secondary transfer structure (i.e., the toner image is initially transferred to the ITM 130 and then at a second area to the media sheet). The sensor 10 may also be used in a variety of other color laser printers, including those with direct toner transfer to the media sheet. The sensor 10 may also be used in a variety of other image forming apparatus including but not limited to mono laser printers, inkjet printers, and facsimile devices.

Co-pending U.S. patent application Ser. No. 11/851,836, entitled "Methods for Determining Widths of Media Sheets within an Image Forming Apparatus" and filed on Sep. 7, 2007, discloses a method of determining a width of a media sheet moving along a media path and is herein incorporated by reference.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. In one embodiment, the flag 25 is positioned away from the media path 90. The present embodiments are, therefore, to be considered in all respects as illustrative and not restrictive, and all changes coming within the meaning and equivalency range of the appended claims are intended to be embraced therein.

What is claimed is:

1. A device to detect widths of media sheets moving along a media path within an image forming apparatus comprising:

a shaft including an elongated shape and being rotationally positioned to extend at least partially across the media path;

first, second, third and fourth paddles each extending outward from the shaft and into the media path, the paddles being axially offset along the shaft, the first paddle aligned at the same position along the media path as the second paddle, the third paddle aligned at the same position along the media path as the fourth paddle, the first and second paddles positioned upstream from the third and fourth paddles;

a flag extending outward from the shaft; and a detector positioned in proximity to the shaft and comprising a transmission path formed between a transmitter and a receiver; and contact between one of the media sheets with a first width and the first and second paddles causing a first degree of rotation of the shaft with a first section of the flag moving through the transmission path between the transmitter and the receiver and causing a first signal to be received by the receiver, and contact between a second of the media sheets with a second width and the third and fourth paddles causing a second degree of rotation of the shaft with a second section of the flag moving through the transmission path and causing a second signal to be received by the receiver.

2. The device of claim 1, wherein a shape of the first, second, third and fourth paddles is substantially the same and the first and second paddles being angularly offset on the shaft from the third and fourth paddles.

3. The device of claim 1, wherein the first, second, third and fourth paddles include different shapes.

4. The device of claim 1, further comprising a window positioned along the second section of the flag.

5. The device of claim 4, further comprising a second window positioned along the first section of the flag.

6. The device of claim 1, wherein the flag is positioned at an axial end of the shaft and is spaced away from the media path.

7. The device of claim 1, wherein the first paddle is symmetrically aligned with the second paddle relative to a reference location on the media path.

8. The device of claim 7, wherein the third paddle is symmetrically aligned with the fourth paddle relative to the reference location on the media path and the first and second paddles are positioned a greater distance from the reference location than the third and fourth paddles.

9. A device to detect widths of media sheets moving along a media path within an image forming apparatus and referenced along a reference location on the media path, the device comprising:

a shaft extending at least partially across the media path;

first, second, third and fourth paddles each extending outward from the shaft and into the media path and being axially spaced apart along a length of the shaft, the first paddle aligned at the same position along the media path as the second paddle and positioned substantially the same distance from the reference location as the second paddle, the third paddle aligned at the same position along the media path as the fourth paddle and positioned substantially the same distance from the reference location as the fourth paddle, the first and second paddles positioned upstream along the media path from the third and fourth paddles and positioned a greater distance from the reference location than the third and fourth paddles;

a flag extending outward from the shaft; and a detector positioned in proximity to the shaft and comprising a transmission path formed between a transmitter and a receiver;

the shaft being rotated during contact between the media sheets and the paddles to move the flag relative to the detector causing variations in a signal received by the receiver to determine a width of the media sheets.

10. The device of claim 9, wherein the first, second, third and fourth paddles include a substantially common shape with the first and second paddles angularly offset on the shaft from the third and fourth paddles.

11. The device of claim 9, wherein the first, second, third and fourth paddles include different shapes.

12. The device of claim 9, wherein the flag includes first and second windows that are positioned such that the first window moves through the transmission path during contact between one of the media sheets with a first width and the third and fourth paddles, and both the first and second windows move through the transmission path during contact between a second of the media sheets with a second width and the first and second paddles.

13. The device of claim 9, wherein the flag includes a plurality of extensions that extend axially relative to the shaft and are spaced apart by gaps.

14. The device of claim 13, wherein one of the transmitter and the receiver is positioned radially inward from the flag and the other of the transmitter and the receiver is positioned radially outward from the flag.

15. A method of detecting widths of media sheets moving along a media path within an image forming apparatus comprising:

positioning an arm across at least a portion of the media path with the arm including a shaft and first, second, third and fourth paddles extending from and axially spaced along the shaft, the first and second paddles being aligned at the same location along the media path, the third and fourth paddles being aligned at the same location along the media path, the first and second paddles being positioned upstream along the media path from the third and fourth paddles and positioned a greater distance from a reference location on the media path than the third and fourth paddles;

moving a wide media sheet along the media path and contacting against the first and second paddles;

rotating the shaft a first amount as the wide media sheet moves along the media path and past the arm;

causing a detector to detect the first amount of rotation of the shaft;

moving a narrow media sheet along the media path and contacting against the third and fourth paddles;

rotating the shaft a second amount as the narrow media sheet moves along the media path and past the arm;

causing the detector to detect the second amount of rotation of the shaft.

16. The method of claim 15, wherein the step of causing the detector to detect the first amount of rotation of the shaft includes moving a window on a flag that extends outward from the shaft to move through a transmission path of the detector.

17. The method of claim 15, further comprising spacing the wide media sheet away from the third and fourth paddles as the wide media sheet contacts the first and second paddles and moves along the media path and past the arm.

* * * * *